US009345324B2

(12) United States Patent
Grabherr

(10) Patent No.: US 9,345,324 B2
(45) Date of Patent: May 24, 2016

(54) DRAWER PULL-OUT GUIDE

(71) Applicant: Julius Blum GmbH, Hoechst (AT)

(72) Inventor: Simon Grabherr, Hoechst (AT)

(73) Assignee: JULIUS BLUM GMBH, Hochst (AT)

( * ) Notice: Subject to any disclaimer, the term of this patent is extended or adjusted under 35 U.S.C. 154(b) by 236 days.

(21) Appl. No.: 14/027,439

(22) Filed: Sep. 16, 2013

(65) Prior Publication Data

US 2014/0015390 A1 Jan. 16, 2014

Related U.S. Application Data

(63) Continuation of application No. PCT/AT2012/000018, filed on Feb. 7, 2012.

(30) Foreign Application Priority Data

Apr. 11, 2011 (AT) ..... 511/2011

(51) Int. Cl.
*A47B 88/00* (2006.01)
*A47B 88/04* (2006.01)

(52) U.S. Cl.
CPC ..... *A47B 88/04* (2013.01); *A47B 88/044* (2013.01); *A47B 88/0407* (2013.01); *A47B 2210/0054* (2013.01)

(58) Field of Classification Search
CPC ..... A47B 88/0042; A47B 88/0055; A47B 88/0477; A47B 88/0481; A47B 2210/0054; A47B 88/0422
USPC ..... 312/331, 334.1, 334.5, 334.6, 334.7, 312/334.8
See application file for complete search history.

(56) References Cited

U.S. PATENT DOCUMENTS 5,375,922 A 12/1994 Brustle et al.
5,588,729 A * 12/1996 Berger ..... 312/334.4
5,664,855 A 9/1997 Lautenschlager et al.
8,052,234 B2 11/2011 Liang et al.
(Continued)

FOREIGN PATENT DOCUMENTS

CN 101426401 5/2009
CN 101669725 3/2010
(Continued)

OTHER PUBLICATIONS

International Search Report (ISR) issued Jul. 9, 2012 in International (PCT) Application No. PCT/AT2012/000018.
(Continued)

*Primary Examiner* — Daniel J Troy
*Assistant Examiner* — Andres F Gallego
(74) *Attorney, Agent, or Firm* — Wenderoth, Lind & Ponack, L.L.P.

(57) ABSTRACT

The invention relates to a drawer pull-out guide (4), comprising a body rail (5) to be fastened to a furniture body (2), an in particular metal drawer rail (7) to be fastened to the drawer (3), and an adjusting device (16) for adjusting the height of the drawer (3) relative to the drawer rail (7), wherein the adjusting device (16) has an adjusting part (19), which is supported so as to be movable along a guiding track (18) to a limited extent in order to adjust the height of the drawer (3), wherein the guiding track (18) is designed as an opening in a leg (7*b*) of the drawer rail (7) extending vertically in the usage position, wherein the guiding track (18) extends at an angle to the horizontal.

13 Claims, 5 Drawing Sheets

(56) References Cited

U.S. PATENT DOCUMENTS

| | | | | |
|---|---|---|---|---|
| 2002/0190618 | A1* | 12/2002 | Salice | 312/334.4 |
| 2004/0119387 | A1* | 6/2004 | Schwaerzler et al. | 312/334.4 |
| 2009/0236959 | A1* | 9/2009 | Liang et al. | 312/334.4 |
| 2015/0275963 | A1* | 10/2015 | Petersson | A47B 88/04 384/22 |

FOREIGN PATENT DOCUMENTS

| | | | |
|---|---|---|---|
| DE | 44 14 462 | | 11/1995 |
| DE | 299 18 558 | | 12/1999 |
| DE | 202 09 517 | | 10/2003 |
| DE | 20 2009 003 886 | | 6/2009 |
| WO | WO 2010037683 | A1 * | 4/2010 |
| WO | 2011/094781 | | 8/2011 |

OTHER PUBLICATIONS

Austrian Patent Office Search Report issued Nov. 30, 2011 in Austrian Patent Application No. A 511/2011.

Chinese Search Report (SR) issued Dec. 8, 2014 in counterpart Chinese Patent Application No. 201280011961.1.

* cited by examiner

DRAWER PULL-OUT GUIDE

BACKGROUND OF THE INVENTION

The present invention concerns a drawer pull-out guide comprising a carcass rail to be fixed to a furniture carcass, a drawer rail (which is, in particular, made of metal) to be fixed to a drawer, and an adjusting device for adjusting the height position of the drawer relative to the drawer rail. The adjusting device has a displacement portion which is mounted limitedly moveably along a guide path for adjustment of the height position of the drawer, and the guide path is in the form of an opening in a limb of the drawer rail. The guide path is formed as a recess in a vertical limb of the drawer rail in the position of use.

The invention further concerns an article of furniture having at least one drawer pull-out guide of the kind to be described, in which a drawer is mounted in such a way that it can be extended relative to a furniture carcass by that drawer pull-out guide.

Adjusting devices for adjusting the height position of a drawer relative to the extendable drawer rail of a drawer pull-out guide are already known and serve to adjust the position of the front panel of the drawer in the mounted position relative to the furniture carcass and relative to the front panels of adjacent drawers, in the heightwise direction (for example DE 20 2009 003 886 U1).

DE 44 14 462 B4 discloses an adjusting device, in which the front region of the drawer can be raised and lowered by a displacement portion which is to be actuated manually. For that purpose, the displacement portion has an inclined guide slot, by which the displacement portion is displaceable relative to an inclinedly extending, plate-shaped guide element of the drawer rail. In that arrangement, the plate-shaped guide element is riveted or clinched to the drawer rail by a fixing plate, which therefore requires an increased expenditure on components and additional finishing steps.

DE 202 09 517 U1 describes a height adjusting device with the features recited in the preamble, in which a slider is moveable along vertically extending guide slots in a heightwise direction by the actuation of an eccentric.

By virtue of the vertically extending slots, the eccentric has to carry the entire load of the drawer, and the eccentric needs to have a high self-locking in order to avoid an unintentional displacement of the eccentric under the load of the drawer. That high self-locking action for the eccentric means that it can only be adjusted with difficulty. There is also the disadvantage that the displacement path of the slider is quite limited by virtue of the vertically extending slots.

SUMMARY OF THE INVENTION

Therefore, the object of the present invention is to provide a drawer pull-out guide of the general kind referred to in the opening part of this specification, having an improved adjusting device.

According to the invention, therefore it is provided that the guide path extends inclinedly relative to the horizontal.

In an embodiment, the inclined guide path can be at an angle relative to the horizontal, which is between 3° and 30°, preferably between 8° and 15°.

In that way, a large part of the load of the drawer is carried by the guide path itself, and only a low level of force has to be blocked to prevent an unwanted relative movement between the displacement portion and the guide path. Moreover, a part of that force is generated by friction between the displacement portion and the guide path. The displacement portion can thus be easily adjusted, and the risk of unwanted downward movement of the displacement portion under load can be substantially eliminated. In addition, the displacement path can also be increased by an inclinedly extending guide path—in comparison to a vertically extending guide path.

The guide path for the displacement portion is cut out directly in the rail material of the drawer rail. In that case, the guide path can be stamped or milled out of the drawer rail in a structurally simple fashion. That permits manufacture without any problem, without any additional components being required.

By virtue of the guide path being formed in the rail material, the guide path is stable and does not have to be fixed by additional means. The risk of a break or another defect in the guide path is thereby practically excluded.

For adjustably raising and lowering the drawer in the front end region thereof, the guide path is provided at a front end region of the drawer rail. For lifting and lowering the rearward end region of the drawer, the guide path can also be arranged in the rear end region of the drawer rail.

For easy adjustability of the height position of the drawer, the displacement portion can be releasably arrested relative to the drawer rail at two or more predetermined latching positions. In a development of the invention, latching elements provided for fixing the latching positions can be formed on the drawer rail separately from the guide path. The latching elements can therefore also be cut out in the material of the drawer rail.

In that case, the latching elements for fixing the latching positions can be provided on a limb of the drawer rail, the limb extending vertically in the position of use, and/or on a limb of the drawer rail extending horizontally in the position of use. Arranging the latching elements on a vertically extending limb and additionally on a horizontally extending limb of the drawer rail has the advantage that the displacement portion, upon displacement thereof, can be guided without tilting, relative to the drawer rail. The latching elements can be formed by notches, embossings and/or projections arranged on the drawer rail.

The article of furniture according to the invention has at least one drawer pull-out guide of the kind in question.

BRIEF DESCRIPTION OF THE DRAWINGS

Further details and advantages of the present invention will be apparent from the specific description hereinafter. In the drawings.

DETAILED DESCRIPTION OF THE INVENTION

Figure 1:
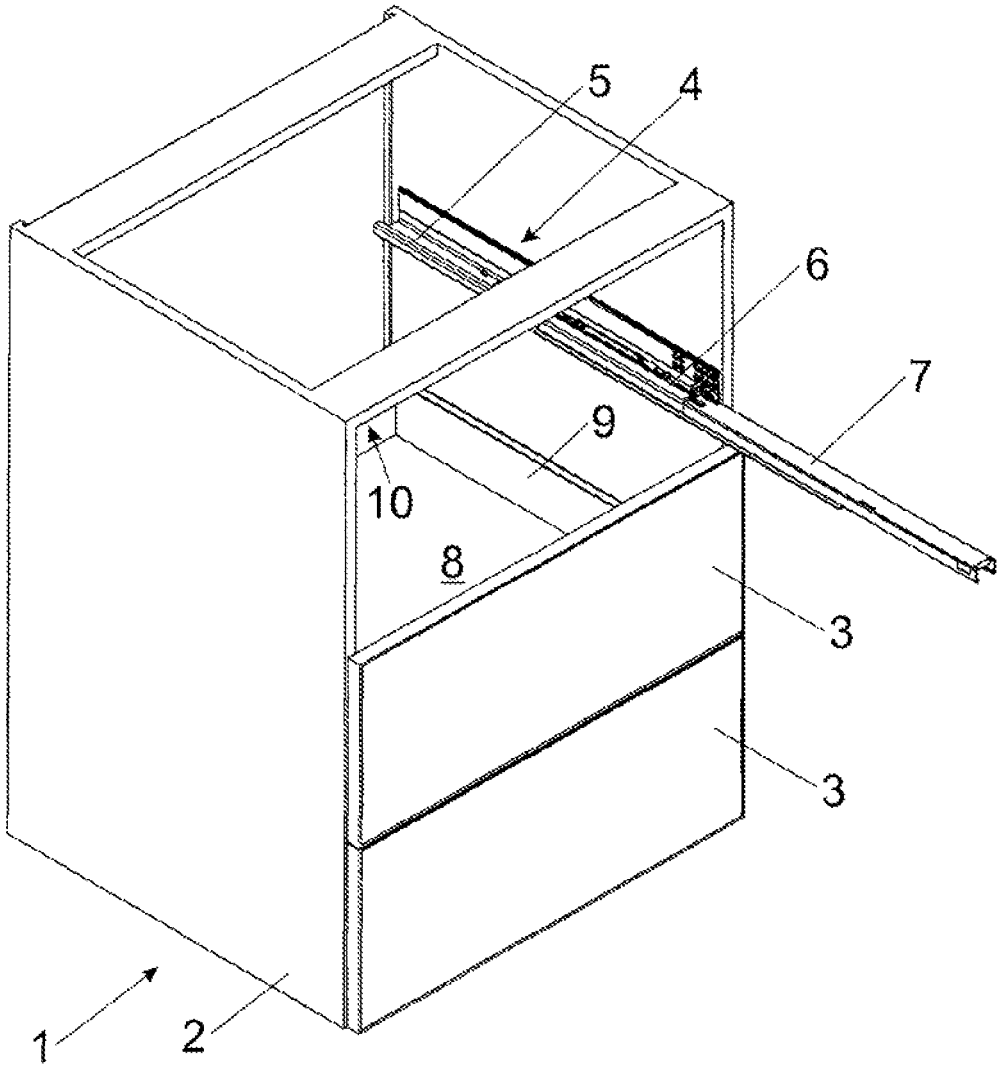
FIG. 1 is a perspective view of an article of furniture with drawers which are mounted displaceably relative to a furniture carcass by way of drawer pull-out guides.

FIG. 1 shows a perspective view of an article of furniture 1, wherein drawers 3 are mounted in such a way that they can be pulled out relative to a furniture carcass 2 by drawer pull-out guides 4. In the illustrated embodiment, the drawer pull-out guide 4 is in the form of a three-part rail system which includes a carcass rail 5 to be fixed to the furniture carcass 2, a central rail 6 displaceable relative thereto and an extendable drawer rail 7 which is connected to the drawer 3 or which is to be releasably connected thereto by a per se known coupling device. The drawer 3 has a drawer bottom 8, drawer side walls 9 and a rear wall 10.

Figure 2:
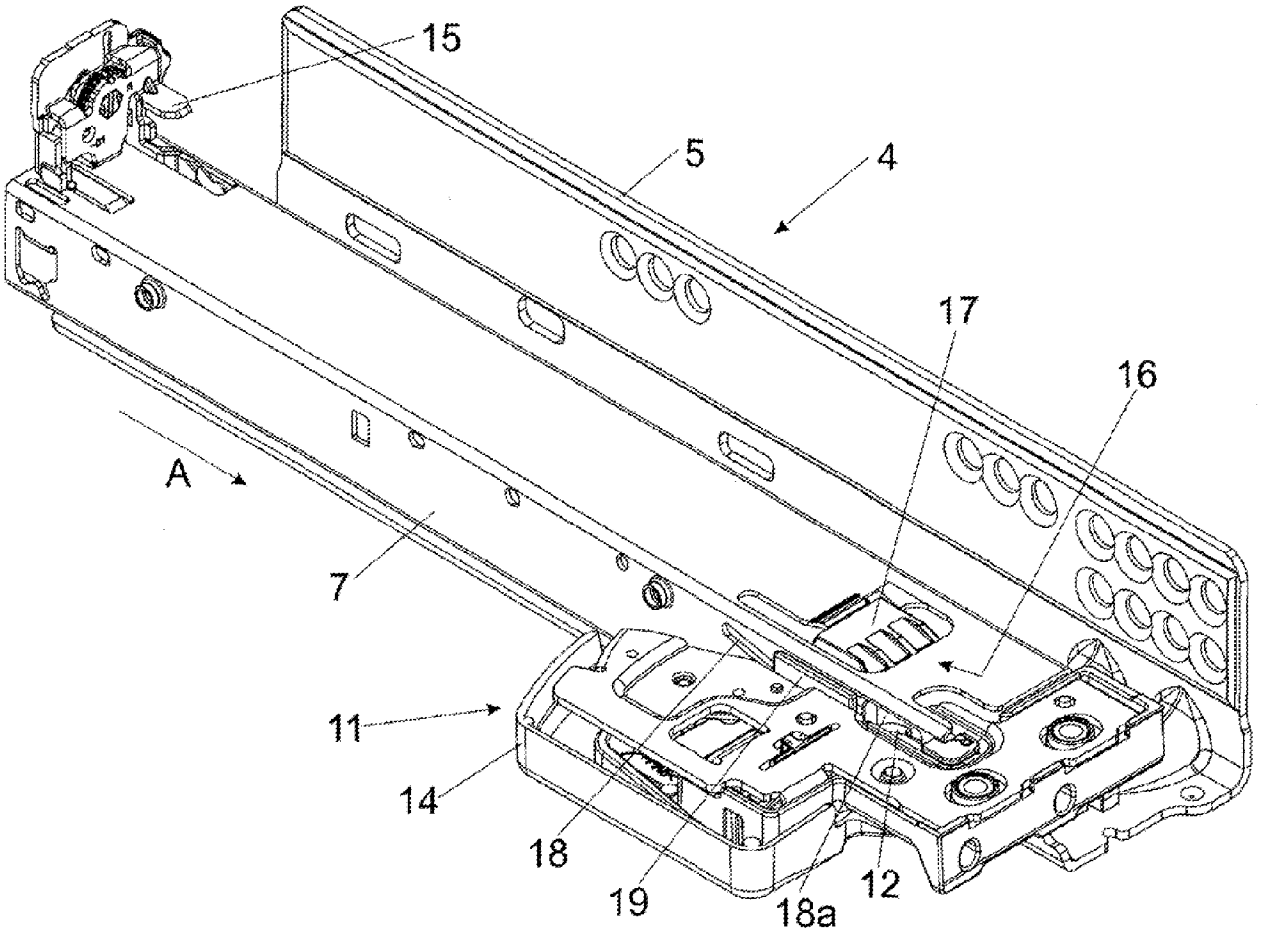
FIG. 2 is a perspective view of an embodiment of a drawer pull-out guide.

FIG. 2 shows a perspective view of a drawer pull-out guide 4. The carcass rail 5 is to be fixed stationarily at the inside of a vertical side wall of the furniture carcass 2, while the drawer 3 is to be connected to the extendable drawer rail 7 by the illustrated coupling device 11. In this arrangement, the coupling device 11 is pre-mounted laterally at the underside of the drawer bottom 8 (FIG. 1) and screwed to the drawer bottom 8 and/or to the drawer front panel. Upon mounting of the drawer 3, it is firstly pushed on to the drawer rail 7 until an abutment 15 arranged on the drawer rail 7 limits the displacement travel of the drawer 3. The abutment 15 is disposed—as is known per se—at the rear end region of the drawer rail 7, and is preferably adapted to be adjustable in respect of height. The abutment 15 extends in parallel spaced relationship relative to a horizontally extending limb 7*a* of the drawer rail 7 and extends in the extension direction (A) of the drawer rail 7 so that, upon mounting of the drawer 3, the abutment 15 can be inserted into a bore in the drawer rear wall 10. The abutment 15 mounted on the rear end of the drawer rail 7 therefore fixes the drawer 3 at its rear end region, while the front end region of the drawer 3 can be releasably coupled to the front end of the drawer rail 7 by the illustrated coupling device 11. The coupling device 11 includes at least one—preferably resilient—latching portion 12 which can be latched into a widened portion 18*a* of an opening in the drawer rail 7. The coupling device 11 further includes a release lever 14, in which case the latching portion 12 can be unlocked by manually applying pressure to the release lever 14, relative to the drawer rail 7, so that the drawer 3 can be completely removed from the drawer rail 7, for example for cleaning purposes.

Reference number 16 denotes an adjusting device by which the front end region of the drawer 3 is height-adjustable. The adjusting device 16 includes a displacement portion 19 which is to be actuated manually, with a support portion 17 connected thereto, the displacement portion 19 being mounted displaceably along an inclinedly extending guide path 18 of the drawer rail 7. In that case, the guide path 18 can be stamped or milled directly out of the rail material of the drawer rail 7. The top side of the support portion 17 bears against the underside of the drawer bottom 8 (FIG. 1) to fix the height position of the drawer 3 so that the drawer 3 can be raised or lowered in the front region at the front panel thereof, by heightwise displacement of the support portion 17.

Figure 3A:
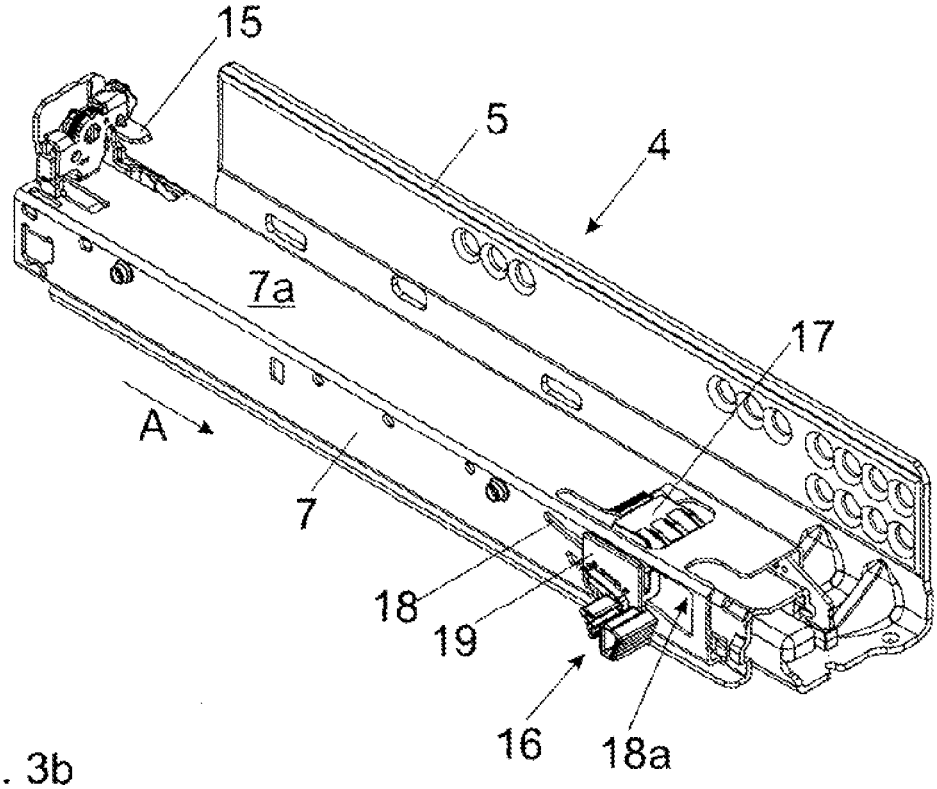
FIGS. 3*a*, 3*b* are perspective views of the drawer pull-out guide with the displacement portion lowered and with the displacement portion raised.

FIG. 3*a* is a perspective view of the drawer pull-out guide 4 of FIG. 2, the coupling device 11 being omitted for reasons of clarity of the drawing. It is possible to see the adjusting device 16 for adjusting the height position of the drawer 3. For height adjustment, the displacement portion 19 is mounted limitedly displaceably along the guide path 18 which falls towards the front end of the drawer rail 7. At one end, the guide path 18 has a widened portion 18*a*, into which the displacement portion 19 can be inserted for mounting thereof to the drawer rail 7, from the side of the drawer rail 7. A particularity of this structure is that the latching portion 12 of the coupling device 11 (FIG. 2) can also be latchingly engaged into the widened portion 18*a* of the guide path 18, to provide for releasable coupling between the drawer 3 and the drawer rail 7. The displacement portion 19 is in the lowermost end position in FIG. 3*a*, in which the top side of the support portion 17 extends substantially flush relative to the horizontal limb 7*a* of the drawer rail 7. Thus, a drawer fitted on to the support portion 17 is in the lowest position relative to the drawer rail 7.

Figure 3B:
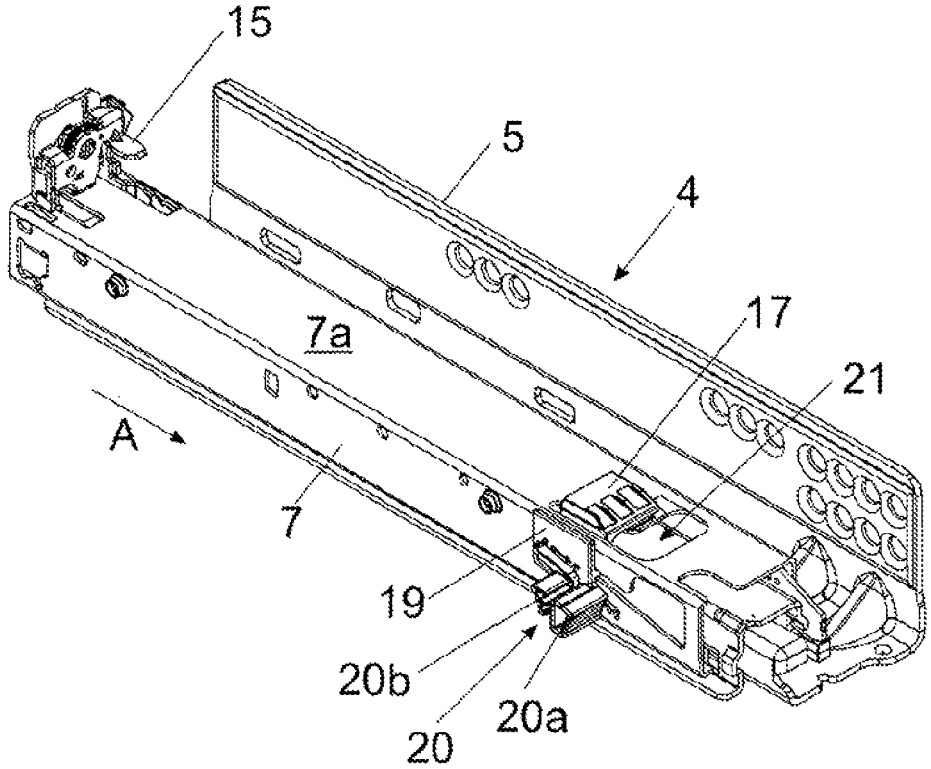

FIG. 3*b*, in contrast, shows the raised end position of the support portion 17, the drawer 3 also being in its position of maximum lifting. The support portion 17 is arranged at least partially in an opening 21 in the horizontally extending limb 7*a* of the drawer rail 7 and passes through that opening, upon height adjustment of the displacement portion 19. For displacement purposes the displacement portion 19 has a gripping portion 20 which is to be actuated manually and which in the illustrated embodiment has a two-part structure. A first gripping portion 20*a* is provided for displacement of the displacement portion 19 in a first direction of movement, while a second gripping portion 20*b* is adapted for release of the displacement portion 19 from a latching position in a second direction of movement opposite to the first direction of movement. In other words, the support portion 17 can be lifted by manually applying pressure to the first gripping portion 20*a*, in opposition to the extension direction (A). By manually applying a pulling force to the second gripping portion 20*b* in the extension direction (A), the latching effect can be released and the support portion 17 can be moved into a lowered position relative to the drawer rail 7.

Figure 4A:
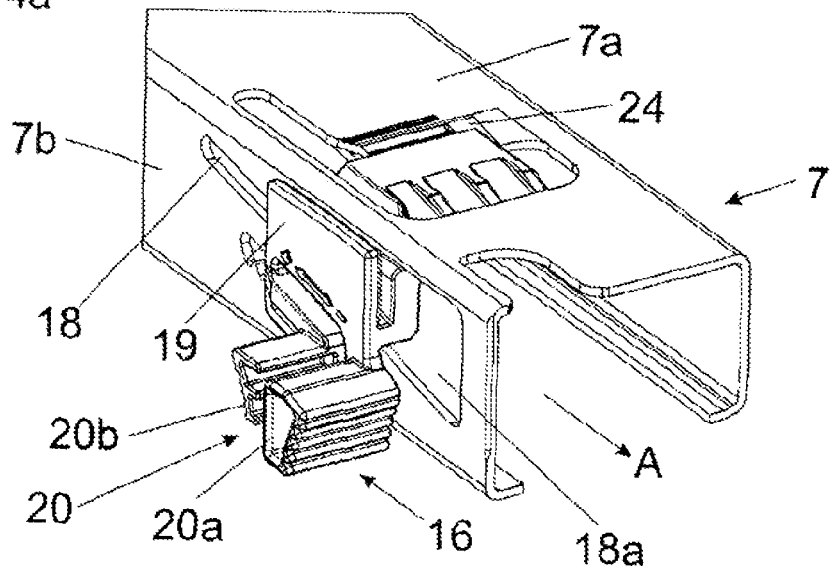
FIGS. 4*a*-4*c* are various views of the front end of the drawer rail with the displacement portion in a lowered and a raised position.

FIG. 4*a* shows a perspective view of the front end region of the drawer rail 7, at which the adjusting device 16 is arranged for adjusting the height position of the drawer 3 in its mounted position. The drawer rail 7 has a C-shaped cross-section with a horizontally extending limb 7*a* and a vertically extending limb 7*b*. In the illustrated embodiment, the inclined guide path 18 is formed as an opening in the rail material of the vertically extending limb 7*b*. The support portion 17 for supporting the drawer 3 is in a lowered position in FIG. 4*b*.

Figure 4B:
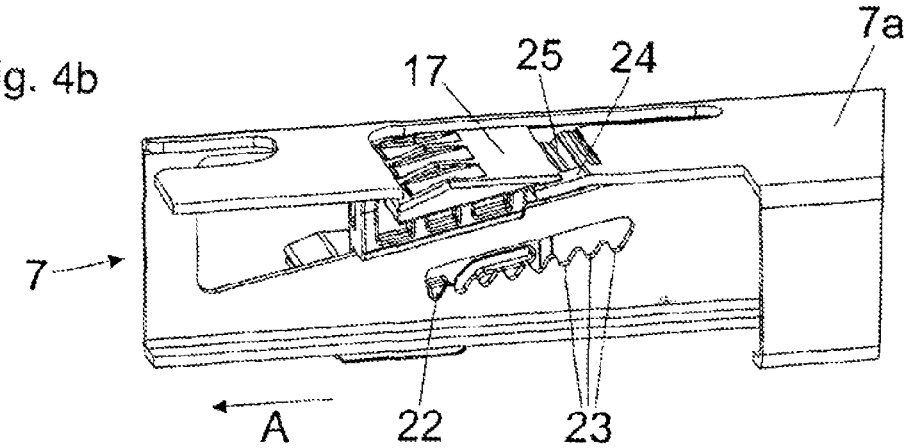

FIG. 4*b* shows a partly broken-away side view of the drawer rail 7. The Figure shows a latching portion 22 connected to the second gripping portion 20*b* and which can be releasably latchingly engaged at various predetermined latching elements 23 which are formed separately from the guide path 18. It is possible to see the support portion 17 which has a substantially wedge-shaped cross-sectional configuration. The underside of the support portion 17 can be supported to slide along an inclinedly downwardly extending portion 24 of the drawer rail 7. Provided at the underside of the support portion 17 are ribs (not visible here) which extend transversely relative to the extension direction (A) and which can be releasably latched to transversely extending latching elements 25 on the inclined portion 24 of the drawer rail 7 at a plurality of predetermined latching positions. The displacement portion 19 can be displaced in a substantially tilt-free fashion upon displacement relative to the drawer rail 7 by virtue of the latching engagement of the latching portion 22 with the latching elements 23 and by virtue of the additional latching of the ribs of the support portion 17 with the latching elements 25 of the inclined portion 24.

Figure 4C:
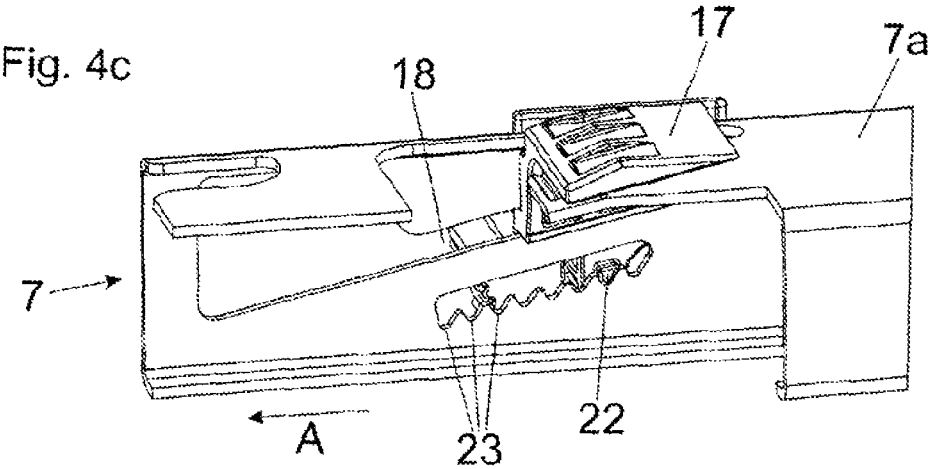

FIG. 4*c* shows the raised position of the support portion 17 relative to the horizontally extending limb 7*a* of the drawer rail 7, in which the support portion 17 is displaceable into a raised position by manually applying pressure to the first gripping portion 20*a*, in a direction opposite to the extension direction (A). The latching portion 22 is resiliently mounted so that the latching portion 22 is automatically latchable with the latching elements 23 of the drawer rail 7 upon displacement into a raised position. By manually applying a pulling force to the second gripping portion 20*b* in the extension direction (A), in contrast, the resilient latching portion 22 can be lifted out of the latching elements 23 so that the support portion 17 can be lowered into a lower position again.

Figure 5A:
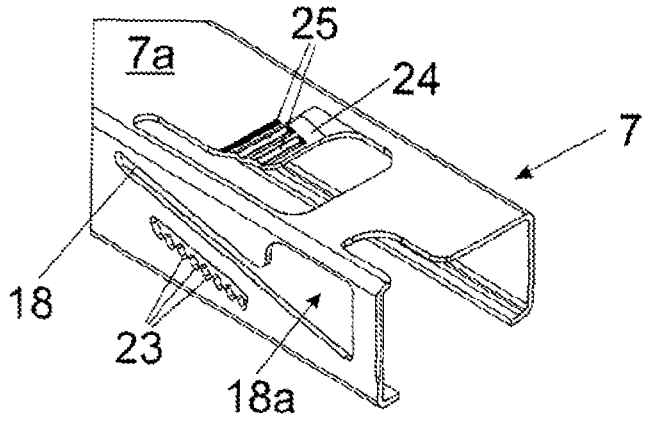
FIGS. 5*a*-5*d* are various views of the front end of the drawer rail and the displacement portion.

FIG. 5*a* shows the front end region of the drawer rail 7 as a perspective view. It is possible to see the guide path 18 and the latching elements which are separate therefrom and which are each in the form of openings in the vertically extending limb 7*b* of the drawer rail 7. The inclined portion 24 for slidingly guiding the support portion 17 has latching elements 25 which are spaced apart in the extension direction (A) and which cooperate with corresponding ribs 26 of the support portion 17 (FIG. 5*c*). The guide path 18 opens into an enlarged portion 18*a* into which, on the one hand, the support portion 17 of the displacement portion 19 can be introduced for mounting thereof and into which, on the other hand, the latching portion 12 of the coupling device 11 is latchable (FIG. 2).

Figure 5B:
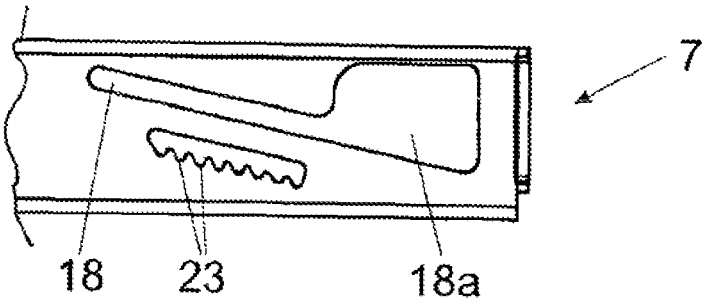
Figure 5C:
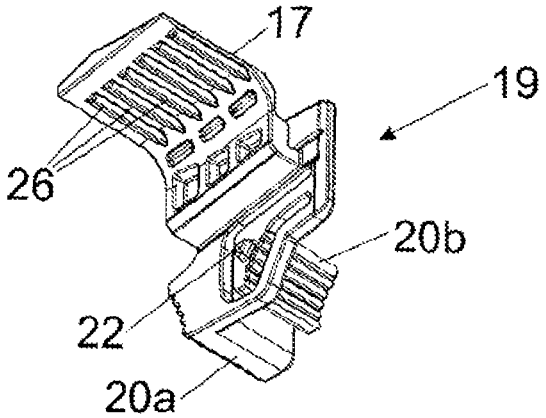
Figure 5D:
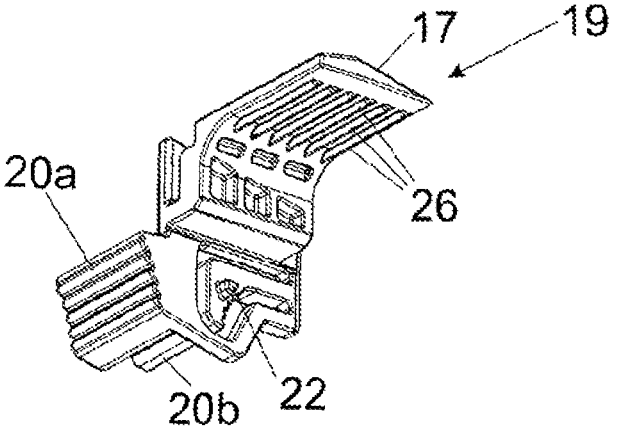

FIG. 5*b* shows the front end region of the drawer rail 7 as a side view. The guide path 18 and the longitudinal extent of the sawtooth-shaped path which is afforded by the latching elements 23 extend in substantially mutually parallel relationship.

FIG. 5*c* shows a perspective view from below of the displacement portion 19. The displacement portion 19 is injection molded in its entirety in one piece from plastic material. The Figure shows the ribs 26 which are provided at the underside of the support portion 17 and which in the mounted position cooperate with the latching elements 25 of the inclined portion 24 (FIG. 5*a*). The latching portion 22 is formed on the second gripping portion 20*b*, and manually pulling on the flexible gripping portion 20*b* in the direction towards the rigid gripping portion 20*a* provides that the latching portion 22 can be lifted out of the latching elements 23 of the drawer rail 7 and thus the latching engagement can be released. FIG. 5*c* shows the displacement portion 19 as a further perspective view from below, and it is possible to see the rigid gripping portion 20*a* and the flexible gripping portion 20*b* with the latching portion 22.

The present invention does not relate only to the illustrated embodiment, but includes or extends to all variants and technical equivalents which can fall within the scope of the accompanying claims. The positional references adopted in the description such as for example up, down, lateral and so forth are also related to the directly described and illustrated Figure and are to be appropriately transferred to the new position. The guide path 18 and/or the path on which the latching elements 23 are arranged for releasable arresting can at least portion-wise be of a linear shape and/or can be at least portion-wise of a curved shape.

A drawer pull-out guide includes a body rail to be fastened to a furniture body, an in particular metal drawer rail to be fastened to the drawer, and an adjusting device for adjusting the height of the drawer relative to the drawer rail. The adjusting device has an adjusting part, which is supported so as to be movable along a guiding track to a limited extent in order to adjust the height of the drawer. The guiding track is designed as an opening in a leg of the drawer rail extending vertically in the usage position, and the guiding track extends at an angle to the horizontal.

The invention claimed is:

1. A drawer pull-out guide comprising:

a carcass rail configured to be fixed to a furniture carcass;

a drawer rail configured to be fixed to a drawer, said drawer rail having a vertical limb with an elongated opening therein, said opening being inclined relative to a longitudinal axis of said drawer rail, and said opening forming a guide path, said drawer rail further having latching elements separate from said opening; and an adjusting device for adjusting a height position of the drawer relative to said drawer rail, said adjusting device including a displacement portion mounted so as to move along said guide path of said drawer rail for adjustment of the height position of the drawer, said displacement portion being configured to be releasably arrested to said drawer rail at any one of at least two latching positions established by said latching elements of said drawer rail;

wherein said displacement portion includes a latching portion configured to be releasably latched to any one of said latching elements, and includes a gripping portion for releasing said latching portion from said latching elements; and wherein said gripping portion is a first gripping portion for displacing said displacement portion in a first direction, said displacement portion further including a second gripping portion for releasing said displacement portion from any one of the latching elements and displacing said displacement portion in a second direction opposite to the first direction.

2. The drawer pull-out guide according to claim 1, wherein said displacement portion further includes a support portion having a top side for bearing against an underside of the drawer so as to fix the height position of the drawer.

3. The drawer pull-out guide according to claim 2, wherein said support portion has an underside surface for bearing against a downwardly inclined extending portion of said drawer rail.

4. The drawer pull-out guide according to claim 1, wherein said guide path is stamped or milled out of said drawer rail.

5. The drawer pull-out guide according to claim 1, wherein said guide path is located at a front end of said drawer rail.

6. The drawer pull-out guide according to claim 1, wherein a first end of said guide path has a widened portion, said displacement portion being configured to be inserted into said widened portion from a side of said drawer rail so as to be mounted to said drawer rail.

7. The drawer pull-out guide according to claim 1, wherein said latching elements are formed on at least one of said vertical limb of said drawer rail and a horizontal limb of said drawer rail.

8. The drawer pull-out guide according to claim 1, wherein said latching elements comprise notches, embossings and/or projections on said drawer rail.

9. The drawer pull-out guide according to claim 1, wherein said displacement portion has a one-piece construction formed of plastic material.

10. The drawer pull-out guide according to claim 1, wherein said drawer rail is formed of metal.

11. An article of furniture comprising:

a furniture carcass;

a drawer; and said drawer pull-out guide according to claim 1 connected to said furniture carcass and said drawer.

12. A drawer pull-out guide comprising:

a carcass rail configured to be fixed to a furniture carcass;

a drawer rail configured to be fixed to a drawer, said drawer rail having a vertical limb with an elongated opening therein, said opening being inclined relative to a longitudinal axis of said drawer rail, and said opening forming a guide path, said drawer rail further having latching elements separate from said opening; and an adjusting device for adjusting a height position of the drawer relative to said drawer rail, said adjusting device including a displacement portion mounted so as to move along said guide path of said drawer rail for adjustment of the height position of the drawer, said displacement portion being configured to be releasably arrested to said drawer rail at any one of at least two latching positions established by said latching elements of said drawer rail;

wherein said displacement portion has a support portion having a top side for bearing against an underside of the drawer so as to fix the height position of the drawer; and wherein said support portion is arranged at least partially within a support opening in a horizontal limb of said drawer rail.

13. A drawer pull-out guide comprising:

a carcass rail configured to be fixed to a furniture carcass;

a drawer rail configured to be fixed to a drawer, said drawer rail having a vertical limb with an elongated opening therein, said opening being inclined relative to a longitudinal axis of said drawer rail, and said opening forming a guide path, said drawer rail further having latching elements separate from said opening; and an adjusting device for adjusting a height position of the drawer relative to said drawer rail, said adjusting device including a displacement portion mounted so as to move along said guide path of said drawer rail for adjustment of the height position of the drawer, said displacement portion being configured to be releasably arrested to said drawer rail at any one of at least two latching positions established by said latching elements of said drawer rail;

wherein said displacement portion has a support portion having a top side for bearing against an underside of the drawer so as to fix the height position of the drawer; and wherein said support portion has a substantially wedge-shaped cross-sectional configuration.

* * * * *